US012403384B2

(12) United States Patent
Lavallee et al.

(10) Patent No.: US 12,403,384 B2
(45) Date of Patent: Sep. 2, 2025

(54) SKATE BLADE HOLDER WITH BLADE ATTACHMENT MECHANISM AND BLADE THEREFOR

(71) Applicant: SPORT MASKA INC., Montreal (CA)

(72) Inventors: Alexandre Lavallee, Ste-Anne-des-Lacs (CA); Andrew Cormack, Deux-Montagnes (CA); Philippe Lapierre, Montreal (CA); Georges-Emmanuel Harvey, Laval (CA); Bernard Daoust, Sutton (CA)

(73) Assignee: SPORT MASKA INC.

( * ) Notice: Subject to any disclaimer, the term of this patent is extended or adjusted under 35 U.S.C. 154(b) by 160 days.

(21) Appl. No.: 18/338,986

(22) Filed: Jun. 21, 2023

(65) Prior Publication Data

US 2023/0405443 A1 Dec. 21, 2023

Related U.S. Application Data

(60) Provisional application No. 63/370,698, filed on Aug. 8, 2022, provisional application No. 63/353,902, filed on Jun. 21, 2022.

(51) Int. Cl.
*A63C 1/16* (2006.01)

(52) U.S. Cl.
CPC ..... *A63C 1/16* (2013.01)

(58) Field of Classification Search
CPC ..... A63C 1/16; A63C 1/303
See application file for complete search history.

(56) References Cited

U.S. PATENT DOCUMENTS 3,026,118 A 3/1962 Pare
4,251,086 A 2/1981 Woolley
4,353,562 A 10/1982 Tiefenthal
(Continued)

FOREIGN PATENT DOCUMENTS

CH 223321 A * 9/1942
JP H11225801 A * 8/1999
(Continued)

OTHER PUBLICATIONS

WO-2019218070-A1 English Translation (Year: 2019).*
KR-200435078-Y1 English Translation (Year: 2007).*
JP-H11225801-A English Translation (Year: 1999).*

*Primary Examiner* — James A Shriver, II
*Assistant Examiner* — Michael T. Walsh
(74) *Attorney, Agent, or Firm* — NORTON ROSE FULBRIGHT CANADA

(57) ABSTRACT

A skate and a replaceable skate blade are disclosed. The skate includes a boot and a blade assembly with a blade holder and a blade removably mounted to the holder. A locking pin is displaceable relative the blade holder between a blade locking position in which a tip of the locking pin is in engagement with the blade and a blade releasing position in which the tip of the locking pin is disengaged from the blade. A pin actuator is engageable by a user for translating the pin actuator along a longitudinal axis of the locking pin, wherein translation of the pin actuator induces translation of the locking pin along the longitudinal axis from the blade locking position to the blade releasing position. A biasing element reacts against the pin actuator and biasing the locking pin in the blade locking position.

22 Claims, 9 Drawing Sheets

(56) References Cited

U.S. PATENT DOCUMENTS

| | | | | |
|---|---|---|---|---|
| 5,088,749 | A * | 2/1992 | Olivieri | A63C 1/303 280/11.18 |
| 5,123,664 | A * | 6/1992 | DeMars | A63C 1/16 280/11.18 |
| 5,332,242 | A | 7/1994 | Cann et al. | |
| 5,484,148 | A | 1/1996 | Olivieri | |
| 5,641,169 | A * | 6/1997 | Bekessy | A63C 1/30 280/11.18 |
| D396,515 | S | 7/1998 | Venier et al. | |
| 5,988,683 | A | 11/1999 | Venier et al. | |
| 6,039,328 | A | 3/2000 | Pawlowski et al. | |
| 6,523,835 | B1 | 2/2003 | Lyden | |
| D631,120 | S | 1/2011 | Salmon | |
| 8,297,627 | B2 | 10/2012 | Smith, II | |
| 8,353,535 | B2 | 1/2013 | Salmon et al. | |
| 8,454,030 | B2 * | 6/2013 | Corbeil | A63C 1/303 280/11.18 |
| 8,534,680 | B1 | 9/2013 | Corbeil et al. | |
| 8,550,472 | B2 * | 10/2013 | Salmon | A63C 1/303 280/841 |
| 9,717,300 | B2 | 8/2017 | Van Horne et al. | |
| 9,855,487 | B2 | 1/2018 | Chartrand et al. | |
| 10,894,200 | B2 * | 1/2021 | Van Horne | A63C 1/303 |
| 2005/0167934 | A1 | 8/2005 | Smith | |
| 2011/0121527 | A1 | 5/2011 | Salmon et al. | |
| 2013/0038031 | A1 | 2/2013 | Cruikshank et al. | |
| 2013/0285338 | A1 | 10/2013 | Blois | |
| 2014/0062041 | A1 | 3/2014 | Maars | |
| 2014/0284890 | A1 * | 9/2014 | Wuerthner | A63C 1/32 280/11.12 |
| 2017/0028291 | A1 | 2/2017 | Green et al. | |
| 2022/0314100 | A1 * | 10/2022 | Yu | A63C 1/02 |

FOREIGN PATENT DOCUMENTS

| | | | | |
|---|---|---|---|---|
| KR | 200435078 Y1 * | 1/2007 | | |
| WO | WO-2019218070 A1 * | 11/2019 | | A43B 5/1641 |

* cited by examiner

SKATE BLADE HOLDER WITH BLADE ATTACHMENT MECHANISM AND BLADE THEREFOR

CROSS-REFERENCE TO RELATED APPLICATION

This application claims priority on U.S. Patent Application No. 63/353,902 filed Jun. 21, 2022, and on U.S. Patent Application No. 63/370,698 filed Aug. 8, 2022, the entire contents of each of which are incorporated by reference herein.

TECHNICAL FIELD

The application relates generally to ice skates and, more particularly, to ice skates having replaceable blades.

BACKGROUND

Since skate boots are generally more durable than skate blades, it is known to provide skates with steel blades detachably received within a holder of the skate, such that the blades can be replaced when worn out or damaged. Furthermore, hockey players and/or equipment managers find value in carrying extra pre-sharpened blades that can be easily/rapidly replaced, during a game for example, which may be required to replace a worn or broken blade during a game or when sharpening of the existing blade is not possible. While existing blade attachment mechanisms are suitable for their intended purposes, improvements in such attachment mechanisms are sought.

SUMMARY

There is accordingly provided a skate comprising: a boot; a blade assembly including: a blade holder attached beneath the boot, the blade holder having a bottom surface defining a groove and recesses extending upwardly from the groove, the blade holder having a socket defining a socket opening located in a lateral side of the blade holder; a blade removably mounted to the blade holder; a locking pin displaceable relative the blade holder along a longitudinal axis between a blade locking position in which a tip of the locking pin is in engagement with the blade and a blade releasing position in which the tip of the locking pin is disengaged from the blade; a pin actuator received within the socket of the blade holder, the pin actuator engageable by a user for translating the pin actuator along the longitudinal axis, the pin actuator engaged with the locking pin such that translation of the pin actuator induces translation of the locking pin along the longitudinal axis from the blade locking position to the blade releasing position; and a biasing element mounted to the blade holder to react against the pin actuator and biasing the locking pin in the blade locking position.

The skate as defined above and described herein may also include one or more of the following features, in whole or in part, and in any combination.

In certain aspects, the blade includes a body defining an ice-engaging edge and a top edge opposite the ice-engaging edge, projections extending from the top edge and away from the ice-engaging edge, the blade moveable with respect to the blade holder between an engagement position in which the top edge is received in the groove and a disengagement position in which the blade is disengaged from the recesses and the groove.

In certain aspects, one of the projections defines a cam surface that is rearwardly facing, and a tip-engaging wall surface merging with the cam surface at a turning point and extending inwardly into said one of the projections, the locking pin in engagement with the tip-engaging wall surface in the blade locking position and disengaged from the tip-engaging wall surface in the blade releasing position.

In certain aspects, a slot is defined in said one of the projections, the tip-engaging wall surface defined by a top edge of the slot.

In certain aspects, the tip of the locking pin has a top edge extending from the apex on an opposite side of the cam surface, at least part of the top edge contacting the tip-engaging wall surface of the projection in the blade locking position.

In certain aspects, the top edge of the locking pin and the tip-engaging wall surface have a complementary outline.

In certain aspects, the tip of the locking pin has an apex and a cam surface extending from the apex, the cam surface being curved.

In certain aspects, the tip of the locking pin has an asymmetric shape relative to a horizontal plane containing the longitudinal axis of the locking pin.

In certain aspects, a bellows extends between the pin actuator and an oppositely facing surface of the blade holder, the bellow surrounding peripherally the biasing element.

In certain aspects, the pin actuator has an annular shape to receive the locking pin therein, the pin actuator having a forward-facing surface angled relative to the longitudinal axis, and a seating surface facing opposite to the forward-facing surface, the seating surface engaging the biasing element.

In certain aspects, the pin actuator is fully recessed within the socket.

In certain aspects, the pin actuator and the biasing element are fully recessed in the socket.

In certain aspects, a damping feature defines an interface with a portion of the top edge of the blade when the blade is engaged with the blade holder, the damping feature located in the groove.

In certain aspects, the blade holder has a front pedestal and a rear pedestal, the damping feature located underneath the rear pedestal.

In certain aspects, the damping feature includes a strip of material softer than a material of the blade holder.

In certain aspects, the blade holder has a front pedestal defining an internal cavity and a rear pedestal, a respective one of the recesses opening into the internal cavity.

In certain aspects, the projections include a front projection and a rear projection, the front projection insertable into a respective one of the recesses defined in the front pedestal, the front projection being forwardly angled.

In certain aspects, the front projection has a tapered shape that converges from a base of the front projection to a tip of the front projection.

In certain aspects, a width of the front projection in a direction transverse to a fore-aft direction is substantially constant along its length.

In certain aspects, at least the base of the front projection matingly engages respective one of the recesses defined in the front pedestal when the blade is in an in-use position.

In certain aspects, the projections include a front projection and a rear projection, the rear projection includes an apex and a cam surface extending from the apex, the cam surface of the rear projection slidingly engaging the cam surface of the locking pin as the locking pin displaces between the blade locking position and the blade releasing position.

There is also provided a locking mechanism for a blade holder compatible with a replaceable blade, the locking mechanism comprising: a locking pin mounted within the blade holder, the locking pin translatable relative to a longitudinal axis thereof between a blade locking position and a blade releasing position, the locking pin including a tip having an apex and a cam surface extending from the apex for engaging with a cam surface of the replaceable blade; a pin actuator receivable within a socket of the blade holder, the pin actuator engaged with the locking pin to displace the locking pin axially between the blade locking position and the blade releasing position, wherein axial displacement of the pin actuator along the longitudinal axis causes translation of the locking pin along the longitudinal axis; and a biasing element mounted to react against the pin actuator and biasing the locking pin in the blade locking position.

The locking mechanism as defined above and described herein may also include one or more of the following features, in whole or in part, and in any combination.

In certain aspects, the tip of the locking pin has an asymmetric shape relative to a horizontal plane containing a longitudinal axis of the locking pin, the cam surface being curved.

In certain aspects, the biasing element includes a spring mounted about the locking pin.

In certain aspects, the locking pin has a peripheral section at an end of the locking pin opposite to the tip, the peripheral section having a non-circular or asymmetric cross-section.

In certain aspects, the peripheral section has at least one flat.

In certain aspects, the tip has an apex from which extends the cam surface, the apex offset relative to the longitudinal axis.

In certain aspects, the tip has a top edge extending from the apex, the top edge flat along at least part of the tip.

In certain aspects, the pin actuator has an annular shape to receive the locking pin therein.

In certain aspects, the pin actuator has a forward-facing surface angled relative to the longitudinal axis, and a seating surface facing in an opposite direction from the forward-facing surface, the seating surface engaging the biasing element.

In certain aspects, a bellows peripherally surrounds the biasing element.

There is further provided a replaceable blade for a skate, the replaceable blade comprising a body defining an ice-engaging edge, a top edge opposite the ice-engaging edge, a first projection and a second projection each extending upwardly from the body, the first and second projections configured for being received within a respective recess defined by a blade holder of the skate.

The replaceable blade as defined above and described herein may also include one or more of the following features, in whole or in part, and in any combination.

In certain aspects, the second projection defines a cam surface that is rearwardly facing, and a tip-engaging wall surface merging with the cam surface at a turning point and extending inwardly into the second projection.

In certain aspects, the tip-engaging wall surface is flat.

In certain aspects, the second projection has an apex, the tip-engaging wall surface located between the top edge of the body and the apex.

In certain aspects, the cam surface has a convex curvature.

In certain aspects, the cam surface extends from the apex to the tip-engaging wall surface.

In certain aspects, the tip-engaging wall surface and the cam surface form an acute angle.

In certain aspects, a slot is defined in the second projection, the slot inwardly extending between the top edge of the body and the apex, the tip-engaging wall surface defined by a top edge of the slot.

In certain aspects, the slot has an asymmetric shape.

In certain aspects, the slot has a bottom edge facing towards the top edge of the slot, the bottom edge is curved.

In certain aspects, the second projection is a rear projection of the replaceable blade, the rear projection engageable with a rear pedestal of a blade holder of the skate, the rear projection having a rearward-facing edge, the tip-engaging wall surface defined in the rearward-facing edge.

In certain aspects, the first projection is a front projection, the front projection being forwardly angled.

In certain aspects, the first projection has a tapered shape that converges from a base of the front projection to a tip of the front projection.

In certain aspects, an upper section of the blade is adapted to be received within a groove of a blade holder of the skate, the upper section extending between a fore end to an aft end of the blade, the upper section having a thickness T1 measurable from the top edge to a boundary line that is offset with and generally parallel to the top edge, wherein the first projection has a height H1, the height H1 at least two times the thickness T1 of the upper section.

In certain aspects, the height H1 is three times the thickness T1 of the upper section.

In certain aspects, the groove of the blade holder has a depth DG and the front projection has a height H1. the height H1 is at least two times the depth DG.

In certain aspects, the height H1 is three times the depth DG of the groove.

There is also provided a skate comprising: a boot and a blade assembly; the blade assembly including: a blade holder attached beneath a sole of the boot, the blade holder having a bottom surface defining a groove and recesses extending upwardly from the groove; a blade including a body defining an ice-engaging edge and a top edge opposite the ice-engaging edge, projections extending from the top edge and away from the ice-engaging edge, a slot defined in one of the projections, the blade moveable with respect to the blade holder between an engagement position in which the top edge is received in the groove and a disengagement position in which the blade is disengaged from the recesses and the groove; a locking pin displaceable within the blade holder along a longitudinal axis between a locked position in which the locking pin is in engagement with the slot and an unlocked position in which the locking pin is disengaged from the slot; a pin actuator received within a socket of the blade holder, the socket having at least one socket opening located on one of opposed lateral sides of the blade holder, the pin actuator engageable by a user for translating the pin actuator along the longitudinal axis, the pin actuator engaged with the locking pin such that translation of the pin actuator induces translation of the locking pin along the longitudinal axis from the locked position to the unlocked position; and a spring mounted within the blade holder to react against the pin actuator and biasing the locking pin in the blade locked position.

In certain embodiments, the blade includes a body defining an ice-engaging edge and a top edge opposite the ice-engaging edge, projections extending from the top edge and away from the ice-engaging edge, a slot defined in one of the projections, the blade moveable with respect to the blade holder between an engagement position in which the top edge is received in the groove and a disengagement position in which the blade is disengaged from the recesses and the groove.

There is also provided a locking mechanism for a blade holder comprising: a locking pin mounted within the blade holder, the locking pin translatable relative to a longitudinal axis thereof between a locked blade position and a released blade position, the locking pin including a tip having an asymmetric shape relative to a horizontal plane extending through a longitudinal axis of the locking pin; a pin actuator within a socket of the blade holder via at least one opening of the socket, the pin actuator engaged with the locking pin to displace the locking pin axially between the locked blade position and the released blade position, wherein axial displacement of the pin actuator along the longitudinal axis causes translation of the locking pin along the longitudinal axis; and a spring mounted to react against the pin actuator and biasing the locking pin in the blade locked position.

There is further provided a replaceable blade for a skate, the replaceable blade comprising a body defining an ice-engaging edge, an elongated top edge opposite the ice-engaging edge, a first projection and a second projection each extending upwardly from the body, the first and second projections configured for being received within a respective recess defined by a blade holder of the skate, the second projection having an inwardly extending slot, the inwardly extending slot having an asymmetric shape.

BRIEF DESCRIPTION OF THE DRAWINGS

Reference is now made to the accompanying figures in which.

DETAILED DESCRIPTION

Figure 1:
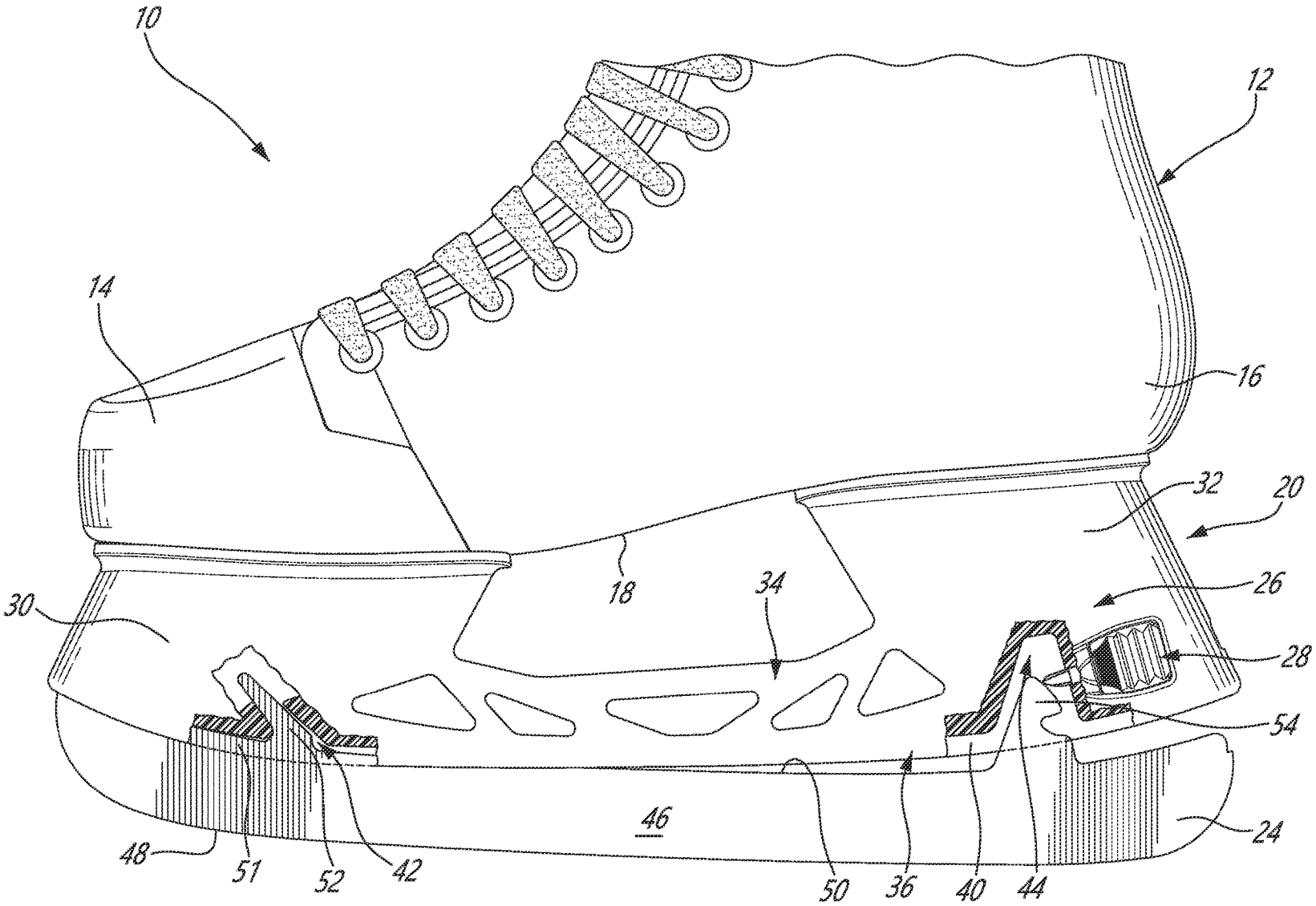
FIG. 1 is a side, partially-sectioned, view of a skate having a blade assembly in accordance with one embodiment of the present disclosure.

Referring to FIG. 1, the ice skate 10 (e.g. an ice hockey skate—hereinafter simply "skate") which includes a blade assembly 20 attached beneath a sole 18 of the boot 12. The blade assembly 20 generally includes a blade holder 26 and a blade 24 that is removably attached to the blade holder 26.

The blade holder 26 includes a front pedestal 30 having a top end configured to be connected to the sole 18 of the boot 12 near a toe portion 14 thereof, a rear pedestal 32 having a top end configured to be connected to the sole 18 of the boot 12 near a heel portion 16 thereof, and a bridge portion 34 interconnecting the front and rear pedestals 30, 32. As will be further described later, the pedestals 30, 32 (or at least one of the pedestals) are hollowed and may define respective internal cavities.

The bottom surface 36 of the blade holder 26 has an elongated groove 40 defined therein, and the blade holder 26 further includes front and rear recesses 42, 44 defined therein, extending upwardly from the elongated groove 40 in alignment with each pedestal 30, 32. The groove 40 and recesses 42, 44 may not be in communication with internal cavities within the pedestals 30, 32. In the depicted embodiment, the front recess 42 communicates with the internal cavity of the front pedestal 30. As depicted in FIGS. 5-9 and described below, the front recess 42 of the blade holder 26 communicates and is opened to an internal cavity 84 within the front pedestal 30 of the blade holder 26. While the rear recess 44 may or may not communicate with an internal cavity in the rear pedestal 32 depending on the embodiment, in the depicted embodiment, the rear recess 44 is enclosed such that it is not in communication with any internal cavities within the rear pedestal 32, and accordingly there is not any communication between an internal cavity of the rear pedestal 32 and the rear recess 44 that receives the rear projection 54 of the blade 24.

The blade 24 has a body 46 having a generally planar shape, preferably having a constant thickness. In a particular embodiment, the blade 24 is made of steel; however other appropriate materials may alternately be used. The body 46 defines an ice-engaging edge 48 configured to slide on ice, and an elongated top edge 50 opposite the ice-engaging edge 48. Two projections 52, 54 extend upwardly from the body 46: a front projection 52 at the front of the blade 24, and a rear projection 54 at the rear of the blade 24. In the embodiment shown, the elongated top edge 50 is free of other projection between the two projections 52, 54. Other configurations are however contemplated, wherein the elongated top edge 50 extending between the two projections 52, 54 may have one or more grooves, cut-outs and/or smaller projections thereon.

Figure 4:
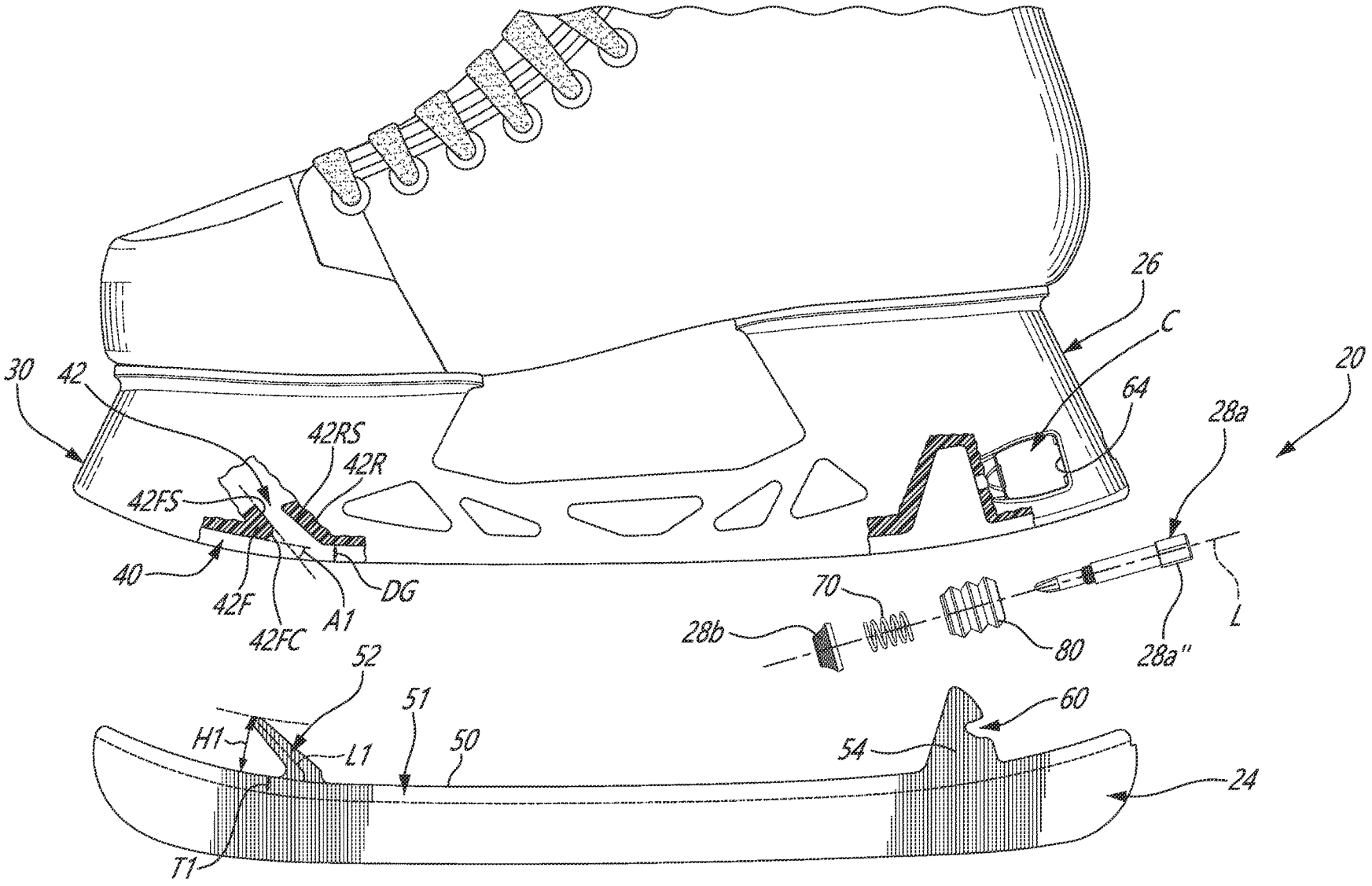
FIG. 4 is a exploded side view of the skate and blade assembly of FIG. 1.

The top edge 50 of the blade 24 and the elongated groove 40 of the holder 26 are configured and sized such as to be complementary and removably engageable together. The top edge 50 is received within the groove 40 when the blade 24 is attached to the blade holder 26. As shown at least in FIG. 1 and with additional reference to FIG. 4, an upper section 51 of the body 46 of the blade 24 is adapted to be received into the groove 40. The upper section 51 extends between a fore end and an aft end of the blade 24. The blade 24 may therefore be laterally supported on opposite sides of its body 46 by the upper section 51 of the body 46 along a substantial 90%)—or all—of the length of the blade 24. The upper section 51 includes the top edge 50. The upper section 51 has a thickness T1 (see FIG. 4) that is measured from the top edge 50, or an imaginary line following the top edge 50, towards the ice-engaging edge 48. As illustrated in FIG. 4, the upper section 51 may be defined longitudinally along the length of the blade 24, and delimited by the top edge 50 and an boundary line that is offset with and generally parallel to the top edge 50. Such thickness T1 may correspond to the depth DG of the groove 40 (described below).

The front projection 52 of the blade 24 and the front recess 42 are configured, positioned and sized so as to be removably engageable one into the other; the rear projection 54 of the blade 24 and the rear recess 44 are configured, positioned and sized so as to be removably engageable one into the other. More particularly, the projections 52, 54 and recesses 42, 44 are configured, positioned and sized such that the blade 24 and blade holder 26 are relatively moveable, with the projections 52, 54 moveable within their respective recess 42, 44, between an engagement position and a disengagement position.

In the engagement position of the blade 24 and holder 26, abutting surfaces of the projections 52, 54 and recesses 42, 44 and interaction between a locking mechanism 28 (described further below) with the blade 24 assist in reducing unintended removal or disengagement of the projections 52, 54 from the recesses 42, 44, thus maintaining the blade 24 in the holder 26. In the disengagement position, the blade 24 is removed from the holder 26; the projections 52, 54 thus have appropriate freedom of movement within the respective recess 42, 44 to allow disengagement of the blade 24 from the recesses 42, 44 and elongated groove 40. Movement between the engagement and disengagement positions of the blade 24 and holder 26 may include translation (e.g. along a longitudinal direction of the blade 24 and/or along an angled direction non-parallel to the longitudinal direction and the vertical direction) and/or rotation of the blade 24 (e.g. pivot around a point defined in or around the recess 42 of the front pedestal 30), depending on the configuration of the projections 52, 54 and recesses 42, 44. This will be described in further detail below, with reference to FIGS. 5-8.

As seen in FIG. 4, the front recess 42 extends through a bottom wall of the front pedestal 30 so that the front projection 52 of the blade is matingly received into the front recess 42.

With further reference to FIG. 4, the front recess 42 has a front wall portion 42F and a rear wall portion 42R facing the front wall portion 42F on an opposite side of the recess 42 in a fore-aft direction of the blade holder 26. The front wall portion 42F defines a bulge or convex surface 42FC facing generally rearwardly. The convex surface 42FC merges with the bottom of the groove 40. Such convex surface 42FC has a turning point and further extends pass the turning point upwardly and forwardly therefrom. As can be seen, the front wall portion 42F generally form an acute angle A1 with the portion of the bottom of the groove 40 extending forward of the front wall portion 42F. The rounded corner defined by the convex surface 42FC is configured to mate with a complementary portion of the projection 52. The convex surface 42FC and the complementary portion of the projection 52 may therefore form a male-female engagement, as will be further described later with reference to FIGS. 5-8. As shown, the front wall portion 42F has a straight wall segment 42FS extending upwardly from the convex surface 42FC and merging therewith. The convex surface 42FC and the straight wall segment 42FS may form one continuous surface. Such straight wall segment 42FS may also be configured to mate with a complementary portion of the projection 52. The rear wall portion 42R of the recess 42 merges with the bottom of the groove 40. The rear wall portion 42R has a straight wall segment 42RS extending forwardly and upwardly from the bottom of the groove 40. Such straight wall segment 42RS is configured to mate with a complementary portion of the projection 52.

As shown, the front projection 52 extends at an angle, such that it is forwardly inclined (i.e. the front projection 52 of the blades extends upwardly and forwardly, to define a forward leaning male projection). The front projection 52 is also tapered, or converging, in shape, wherein the front projection 52 is wider (in a fore-aft direction of the blade 24) at its base than at its remote tip. The forward inclination and/or the converging shape of the front projection 52 enables the front projection 52 of the blade 24 to be easily received within the front recess 42 when the blade 24 is being installed into the blade holder 26, as will be described in further detail below with reference to FIGS. 5-8. The front projection 52 has a length L1 that is defined from its base to its remote tip. Such length L1 may be the length of a central line, which may be non-straight, extending from a middle of its base to the remote tip. The front projection 52 has a height H1 which may be defined as a distance from the top edge 50 of the blade 24, immediately adjacent of the base of the projection 52 and a tangent line at the tip of the projection that generally parallel to the top edge of the blade 24. In at least some embodiments, such height H1 is at least two times that of a depth DG of the groove 40 defined as a distance between the bottom of the groove 40 and the bottom surface 36 of the blade holder 26. In an embodiment, the height H1 is three times (±10%) that of the depth DG. Such proportions may correspond to the proportions of the height H1 and the thickness T1 (described above) of the upper section 51 of the blade 24, where the thickness T1 is measured immediately adjacent to the base of the front projection 52, or aligned therewith. Having such a height H1 relative to the depth DG of the groove 40 and/or thickness T1 of the upper section 51 adapted to be received in the groove 40 may make unintended retraction of the projection 52 from the recess 42 more difficult than some alternative with lower height H1. Once fully mated within the cooperating front recess 42, such a higher height projection 52 may cause the blade 24 to be less easily disconnected from the blade holder 26 in the event of warping or deformation of the blade holder (which can sometimes occur, for example, when the blade holder is hit by a puck).

Figure 2:
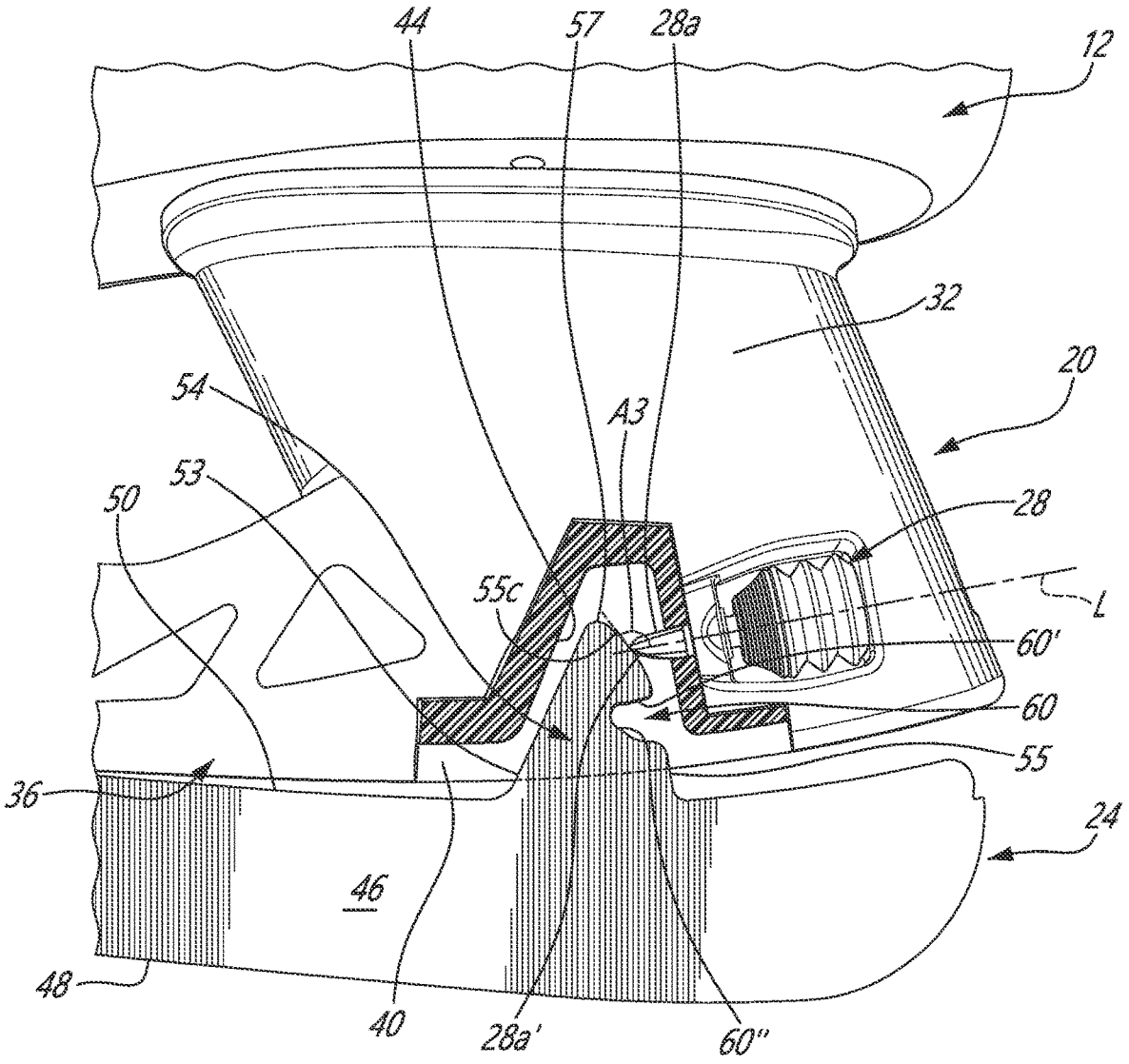
FIG. 2 is an enlarged side, partially sectioned, view of the blade assembly of FIG. 1, showing a blade attachment mechanism disengaged from a blade.

Referring now more particularly to FIG. 2 and the rear projection 54, the rear projection 54 of the blade 24 has a generally pyramid or fin-like shape (when viewed from the side), and defines a forward-facing edge 53 and a rearward-facing edge 55 that extend up from the top edge 50 of the body 46 of the blade 24 and meet at an apex 57 of the rear projection 54.

As seen in FIG. 2, at least the rearward-facing edge 55 is slightly curved, or stated differently the rearward-facing edge 55 of the rear projection 54 has a greater curvature (e.g. radius of curvature about an axis transverse to the blade 24) than that of the frontward-facing surface 53 of the rear projection 54. In the depicted embodiment, the frontward-facing surface 53 is substantially straight, although alternatives are possible. Accordingly, the curved rearward-facing edge 55 of the rear projection 54 of the blade 24 forms a curved surface having a convex curvature (which may also be referred to as a cam surface 55*c*) along which a tip 28*a*' of the locking pin 28*a* of the locking mechanism 28 is able to slide. In other embodiments, such cam surface 55*c* formed by the rearward-facing edge 55 may be at least partially straight, or even entirely straight, from the apex 57 and enable the sliding of the tip 28*a*' of the locking pin 28*a* of the locking mechanism 28. As can be seen in FIG. 2, the relative orientation of the cam surface 55*c* and the angle of attack of the locking pin 28*a*, or angle A3 between the longitudinal axis L and a tangent of the cam surface 55*c* is an obtuse angle so as to effect a pushing motion against the locking pin 28*a* when the projection 54 is inserted into the recess 44.

Figure 3A:
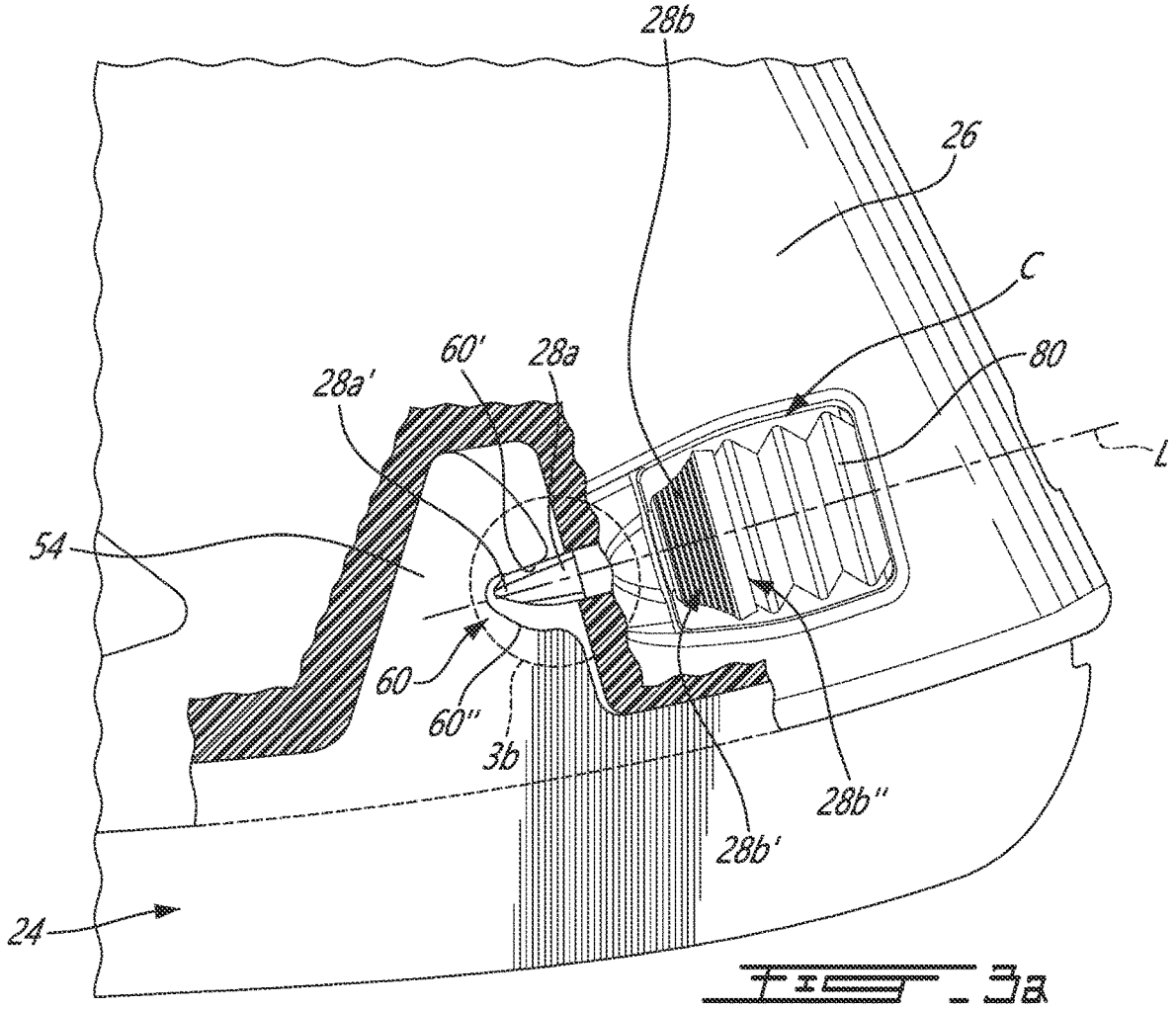
FIG. 3*a* is a side, partially sectioned, view of the blade attachment mechanism of FIG. 2, shown engaged with a blade.

Referring now to FIGS. 2 and 3, the rear projection 54 also includes a tip-engaging wall surface defined therein. Such tip-engaging wall surface is defined at an end of the cam surface 55*c*. The tip-engaging wall surface extends inwardly into the rear projection 54, from the cam surface 55*c*. The tip-engaging wall surface is adapted to engage with the tip 28*a*' of the locking pin 28*a* once such tip 28*a*' has slidden on the cam surface 55*c* to gain the blade locking position as described below. In the depicted embodiment, such tip-engaging wall surface is defined by a slot 60 defined in the rear projection 54. The slot 60 is defined in the rearward-facing edge 55 of the rear projection 54 and is open rearwardly, as shown in FIG. 2. The slot 60 is located at a predetermined position above the top edge 50 of the body 46 of the blade 24, and more particularly at a point between the top edge 50 of the body of the blade 24 and the apex 57 of the rear projection 54. The slot 60 is sized, shaped and positioned to receive the tip 28*a*' of the locking pin 28*a* therein (as will be described in further detail below).

In at least some embodiments, as seen in FIGS. 2 and 3, the slot 60 has an asymmetrical shape. More particularly, as shown, the slot 60 is defined at least in part by a top edge 60' that extends substantially linearly into the rear projection 54 from the rearward-facing edge 55, thereby forming the tip-engaging wall surface described above, and a bottom edge 60" that is curved in this example. The bottom edge 60" thus may differ from the top edge 60' to define the asymmetrical shape of the slot 60 in the rear projection 54 of the blade 24.

As shown, the top edge 60' merges with the cam surface 55*c* at a turning point. In at least some embodiments, the top edge 60' and the cam surface 55*c* extending between the apex 57 and the slot 60 may form an angle A4 (FIG. 3*b*) that is equal or smaller than 90 degrees. Having an acute angle between the top edge 60' and the cam surface 55*c* allows said cam surface 55*c* to progressively push away the locking pin 28*a* along the longitudinal axis L of the locking pin 28*a*, as the locking pin 28*a* slides thereon during insertion of the projection 54 in a direction transverse to the longitudinal axis L.

In embodiments where the cam surface 55*c* is curved, such angle may be measured between a projection line extending from the apex 57 to a turning point at the junction of the cam surface 55*c* and the top edge 60', and a projection line extending along the top edge 60' and crossing with the projection line at the turning point. Depending on the shape of the projection 54, e.g., more or less acute at the apex 57), and/or general orientation of the projection 54 when engaged in the recess 44 in the engagement position, the top edge 60' may extend at least partially away from the apex 57. Stated differently, the top edge 60' may extend in a direction having a vector component heading away from the apex 57. The slot 60 may thus extend downwardly relative to the apex 57, from its opening along the rearward-facing edge 55. In fact, the slot 60 may also be shaped as an opening that does not include a bottom edge 60", in which case the slot 60 may instead define and be referred to as a cut-out or opening in the rear projection 54.

The slot 60 is configured to be engaged by the locking mechanism 28 for either maintaining the elongated blade 24 within the blade holder 26 or for allowing the elongated blade 24 to be removed from the blade holder 26 for substituting the blade 24 by another blade.

Further in accordance with the depicted embodiment, the slot 60 of the rear projection 54 faces toward the rear, or the heel portion 16, of the skate 10 whereas the front projection 52 extends forwardly toward the front, or the toe portion 14, of the skate 10.

The different components of the blade holder assembly 20 having been set forth, the locking mechanism 28 is now described in further detail herein below. The locking mechanism 28 configured for maintaining the blade 24 and blade holder 26 in their engagement position may be connected to the rear pedestal 32, and movable between a locked position (FIG. 3) and an unlocked position (FIGS. 1 and 2).

Figure 5:
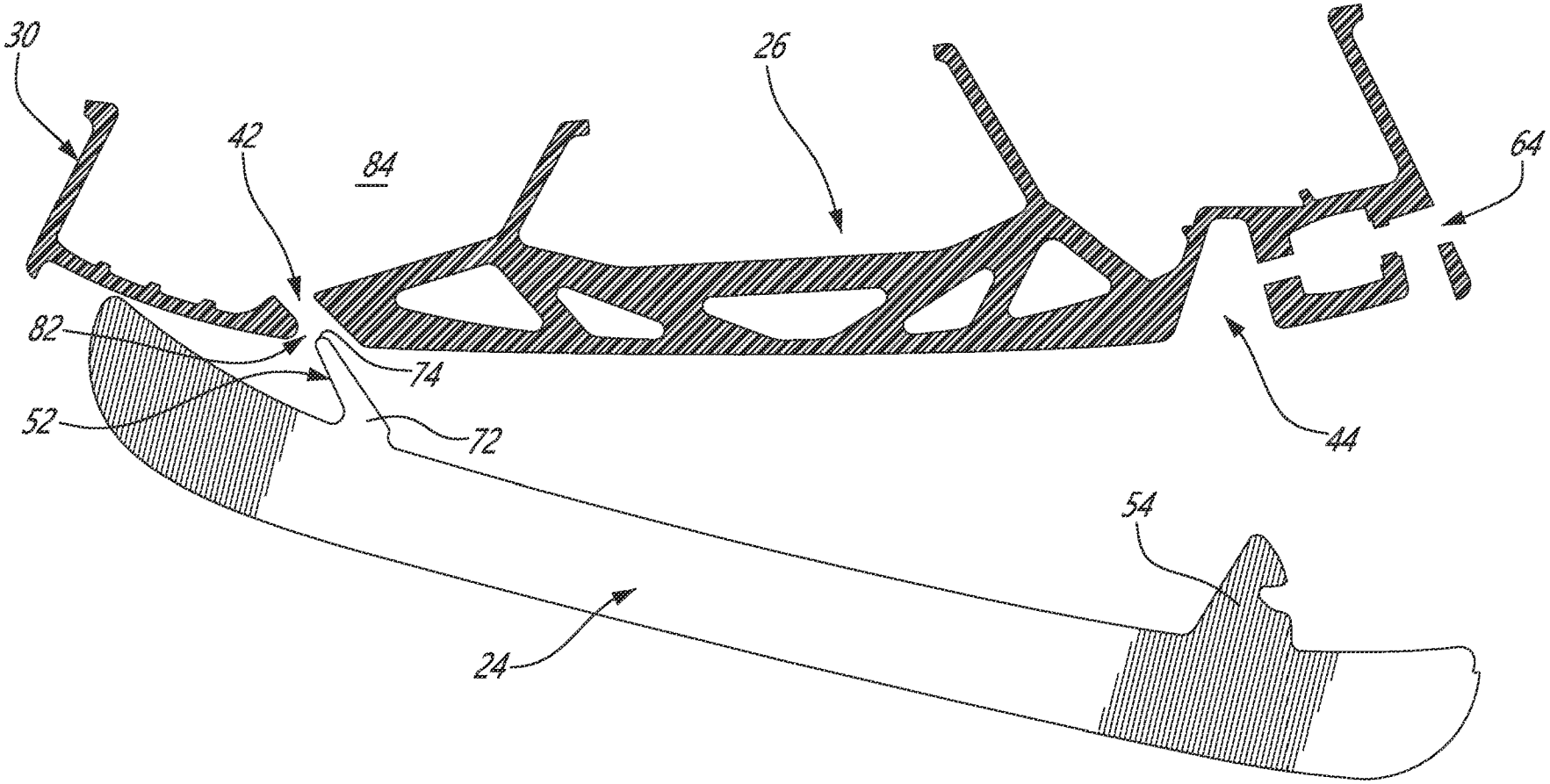
FIG. 5 is a cross-sectional view of the blade assembly of FIGS. 1-2, with the blade attachment mechanism removed and shown with the blade in a disengaged position relative to a blade holder of the blade assembly.

Referring to FIGS. 1-4, the locking mechanism 28 includes a locking pin 28*a* engaged to the holder 26 and received in the aperture 64 (see FIGS. 4-5). The locking pin 28*a* has a tip 28*a*' that defines an engagement end of the locking pin 28*a* and which, in the locked position (blade locking position), protrudes into the recess 44 and is received in the slot 60 of the rear projection 54 of the blade 24 (see FIG. 3), thus maintaining the rear projection 54 of the blade in the recess 44 of the blade holder 26, and maintaining the blade 24 in the engagement position. In the unlocked position (blade releasing position), the locking pin 28*a* is retracted by being longitudinally displaced along a longitudinal axis L of the pin 28*a*, and accordingly disengaged from the rear projection 54, so that the blade 24 can be removed. The locking pin 28*a* is thus displaceable along the longitudinal axis L thereof between the locked position and the unlocked position. The locking pin 28*a* is engaged with the slot 60 in the locked position and disengaged from the slot 60 in the unlocked position.

Figure 3B:
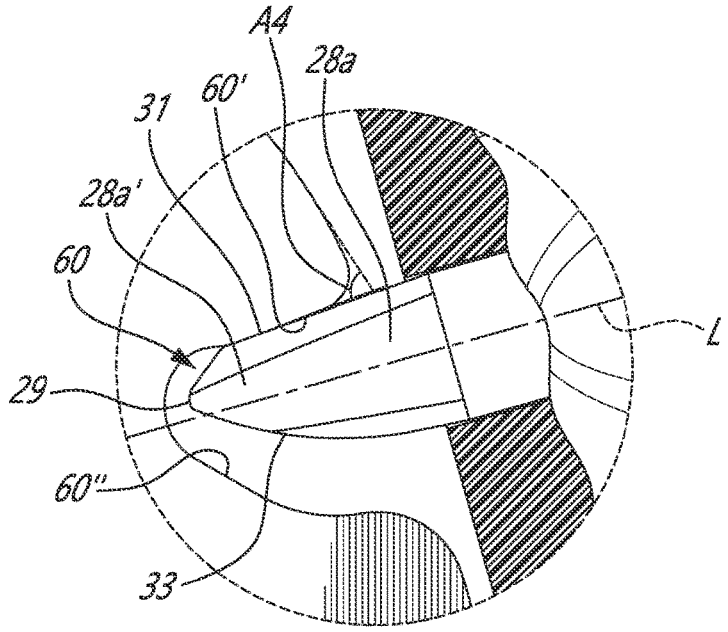
FIG. 3*b* is an enlarged view of the tip of a locking pin of the blade attachment mechanism of FIG. 3*a*, shown in a slot of the blade.

As best seen in FIG. 3*b*, the tip 28*a*' of the locking pin 28*a* may have a shape that is complementary to the shape of the slot 60. More particularly, in the depicted embodiment, the tip 28*a*' includes a top edge 31 of the locking pin 28*a* and a cam surface 33 that extends away, rearwardly, from the top edge 31. As such, the tip 28*a*' of the locking pin 28*a* has an asymmetric shape—which may be defined for example relative to a horizontal plane extending through/containing the longitudinal axis L. As shown, the tip 28*a*' may have an apex 29, from which extends the top edge 31 and/or the cam surface 33. The apex 29 may not be aligned with the longitudinal axis L, i.e., it may be offset relative to the longitudinal axis L. The tip 28*a*' of the locking pin 28*a* acts somewhat like a door latch, in that the cam surface 33 is capable of easily sliding against the cam surface 55*c* of the rearward-facing edge 55 of the rear projection 54 on the blade 24, as the rear projection 54 of the blade 24 is inserted into the recess 44 of the blade holder 26. The cam surface 55*c* of the rear projection 54 and the cam surface 33 of the locking pin 28*a* may therefore define parts of a cam assembly. In at least some embodiments, as shown, the cam surface 33 of the locking pin 28*a* may be curved. Curvature of the cam surface 55*c* of the rear projection 54 may have a constant or varying curvature along its length between the apex 57 and the turning point with the top edge 60'. As shown, the curvature of the cam surface 33 is a convex curvature. During sliding engagement of the cam surface 33 of the locking pin 28*a* and the cam surface 55*c* of the projection 54, the locking pin 28*a* may progressively push the locking pin 28*a* towards the unlocked position. Because the locking pin 28*a* is biased in its extended (locked)

position, as will be described in further detail below, once the tip 28*a*' of the locking pin 28*a* reaches the slot 60 in the rear projection 54 of the blade 24, the tip 28*a*' may project into the slot 60 and thereby retains the blade 24 in place on the blade holder 26.

In at least some embodiments, the top edge 31 of the locking pin 28*a* may have a complementary outline with that of the top edge 60'. Such complementary outline may be flat or straight, as shown. At least part of the top edge 31 of the locking pin 28*a* may contact the top edge 60' when in the locked position. In an embodiment, the top edge 31 of the locking pin 28 may be coplanar with the longitudinal axis L and/or coplanar with the top edge 60'. Such coplanar configuration of the top edge 60' and the top edge 31 of the locking pin 28*a* may provide a greater contact surface between both the locking pin 28*a* and the projection 54. These factors, in combination with the extent to which the locking pin 28*a* extends into the slot 60 may all contribute to better preventing unintended retraction of the locking pin 28*a* from the slot 60. The tip 28*a*' of the locking pin 28*a* may contact an end of the slot 60, depending on the depth thereof, when in the locked position; however this is optional. The slot 60 may be sized so as to receive the tip 28*a*' while still having a clearance (no interference) with the end of the slot 60. Similarly, the cam surface 33 of the locking pin 28*a*—the surface facing towards the bottom edge 60"—may not contact the bottom edge 60" in the locked position. In some embodiments, however, the slot 60 may sized and shaped so as to have mating engagement, or contact, between the bottom edge 60" and the curved surface 33.

The locking mechanism 28 further includes a pin actuator 28*b* which is mounted to the locking pin 28*a* and translatable therewith along the longitudinal axis L. In one particular embodiment, the pin actuator 28*b* is fixed in place on the locking pin 28*a*, such that no relative movement therebetween is possible. Fixing may be tread engagement, or interference fit for example. By grasping the pin actuator 28*b* and translating it along the longitudinal axis L, the locking pin 28*a* is in turn translated axially along the axis L. In the depicted embodiment, for example, by grasping the pin actuator 28*b* and translating it rearwardly (e.g. to the right in FIG. 3), in a direction away from tip 28*a*', the locking pin 28*a* will be displaced from the locked position (as shown in FIG. 3) to the unlocked position (as shown in FIG. 2).

In the depicted embodiment, the pin actuator 28*b* has an annular shape. The pin actuator 28*b* may be concentrically fixed to the locking pin 28*a*. The locking pin 28*a* may extend through the pin actuator 28*b*. In at least some embodiments, as shown, the pin actuator 28*b* has a textured surface 28*b*' to facilitate grasping and/or limit slippage at contact for actuation of the locking mechanism 28. The surface 28*b*' is forwardly facing, such that, upon grasping, the user may apply a load on the surface 28*b*' in the direction of translation so as to translate the pin actuator 28*b* along the longitudinal axis L. In the embodiment shown, the surface 28*b*' is angled relative to the longitudinal axis L. The surface 28*b*' could be normal to the longitudinal axis L in other embodiments. Such surface 28*b*' may not be textured in other embodiments. The pin actuator 28*b* includes a seating surface 28*b*" facing in an opposite direction as the surface 28*b*'. The seating surface 28*b*" is adapted to engage with the biasing element 70 and/or bellows 80, which are described later.

As seen in FIGS. 2 and 3, the pin actuator 28*b* is accessible through a corresponding socket C defined in the blade holder 26 and extending from one lateral side of the blade holder 26 to the other, so that the pin actuator 28*b* is accessible to the user via either one of the lateral sides of the blade holder 26. The socket C could have other configurations in other embodiments. For example, in some variants, the socket C receiving the pin actuator 28*b* may be opened only towards a medial side or lateral side of the blade holder 26. The socket C could form a receptacle enclosure in which the pin actuator 28*b* may partially be recessed, with access to such receptacle enclosure only possible from a single lateral side of the blade holder 26 or both lateral sides of the blade holder 26, as shown. Access to the enclosure or pin actuator 28*b* from both lateral sides (lateral and medial) of the blade holder 26 may facilitate a manual holding/pinching of the pin actuator 28*b* for unlocking operation. In an embodiment, the pin actuator 28*b* is sized to be fully recessed within the socket C. This may prevent undesired contacts in a translation direction with external objects, hence limit undesired activation of the locking mechanism 28 during skating or in a context of normal use, for instance the practice of hockey.

The locking pin 28*a* is biased in the locked position (FIG. 3), using a spring 70 (see FIG. 4) that is mounted about the locking pin 28*a* and is concentric with the longitudinal axis L. The spring 70 is axially mounted between a surface of the blade holder 26 and the pin actuator 28*b*, so as to exert a biasing force against the pin actuator 28*b* in the direction of the rear projection 54 of the blade 24 (and more specifically in the direction of the slot 60 therein)—i.e. towards the left in FIG. 3. In one embodiment the spring 70 is a helical compression spring, as shown in FIG. 4. Alternately, the spring 70 may be an another suitable spring or biasing element, including for example one or more spring blades and/or an elastomeric element, capable of generating the biasing force on the locking pin 28*a* to bias it toward the locked (fully extended) position. In at least some embodiments, the biasing element is fully recessed within the socket C.

In the depicted embodiment, a bellows 80 may also be provided to surround and protect the spring 70. In the depicted embodiment, the bellows 80 is a rubber or other suitable flexible material, and is capable of being collapsed—when the locking pin 28*a* is retracted (FIG. 2)—and of expanding—when the locking pin 28*a* is extended (FIG. 3). The bellows 80 accordingly serves to protect the spring 70 and a portion of the locking pin 28*a* that would be otherwise exposed within the lateral openings of the socket C in the blade holder 26. The bellows 80, if present, may be fully recessed in the socket C.

In some embodiments, the bellows 80 may contribute to the biasing force, but this is optional. The bellows 80 may offer low resistance to compression so as not to impede the retraction of the locking pin 28*a* towards the unlocked position. As shown, the bellows 80 may extend from the pin actuator 28*b* to an oppositely facing surface of the blade holder 26. The bellows 80 may surround peripherally an entirety of the spring as shown. While item 80 is referred to as a bellow, it could also be referred to as a protective sleeve, resiliently deformable. When compressed between the pin actuator 28*b* and the oppositely facing surface of the blade holder 26, such protective sleeve may resiliently deform as the spring 70 is correspondingly compressed to retract the locking pin 28*a* in the unlocked position.

Optionally, a friction device, such as for example a rubber washer, may be used to limit travel of the locking pin 28*a* and/or to help reduce vibrations caused by normal use of the skate from unwanted displacement of the locking pin 28*a*.

Rotation of the locking pin 28*a* about the axis L may, such as in the depicted embodiment, be limited and/or completely prevented. For this purpose, an anti-rotation feature is provided. As shown, the anti-rotation feature is created by an engagement between a peripheral section (e.g. a rearmost portion) of the locking pin 28*a* and an internal surface of the aperture 64 in the blade holder 26. In the embodiment shown, the anti-rotation feature is created by the engagement of non-circular corresponding cross-sections of the peripheral section of the locking pin 28*a* and of the internal surface of the aperture 64. In an embodiment, as shown, the peripheral section 28*a*" at the rear of the locking pin 28*a* may have at least one flat so as to define a non-circular or asymmetric cross-section. The cross-section of the peripheral section 28*a*" at the rear of the locking pin 28*a* may have, for example, a rectangular or square cross-sectional shape. Other non-circular cross-section could be contemplated, such as other polygonal cross-sections (e.g., pentagonal, hexagonal, heptagonal, octagonal), or other cross-sections of irregular geometry. Flats are only one possibility that may form anti-rotation feature. Crenellations, undulations, peaks and valleys distributed about the peripheral section 28*a*" are some other possibilities. The non-circular corresponding cross-sections may not be identical to one another as along as their engagement limits rotation of one relative to the other about the axis L. The anti-rotation features allow a translation displacement of the locking pin 28*a* within the aperture 64. As the locking mechanism 28 is actuated to retract the locking pin 28*a*, the peripheral section 28*a*" may slide or otherwise translationally move within the aperture 64. Translational movement of the locking pin 28*a* in the aperture 64 may be enabled by relaxed tolerance therebetween, e.g., sliding engagement. Lubricant, such as silicone lubricant, could be sprayed into the bellows 80 or in the aperture 64 before mounting the locking pin 28*a* in place therein to allow even freer sliding.

In a particular embodiment, the locking mechanism 28, which remains at least in major part, and in some embodiments in entirety, outside of the pedestal's internal cavities, is easily accessible and engageable by the user, while still providing for sufficient retention of the blade 24 in the blade holder 26.

Referring now to FIGS. 5-8, the manner in which the blade 24 and the blade holder 26 are matingly engaged, and thus the manner that the blade 24 is received within (and removed from) the blade holder 26, will now be described in further detail.

Figure 8:
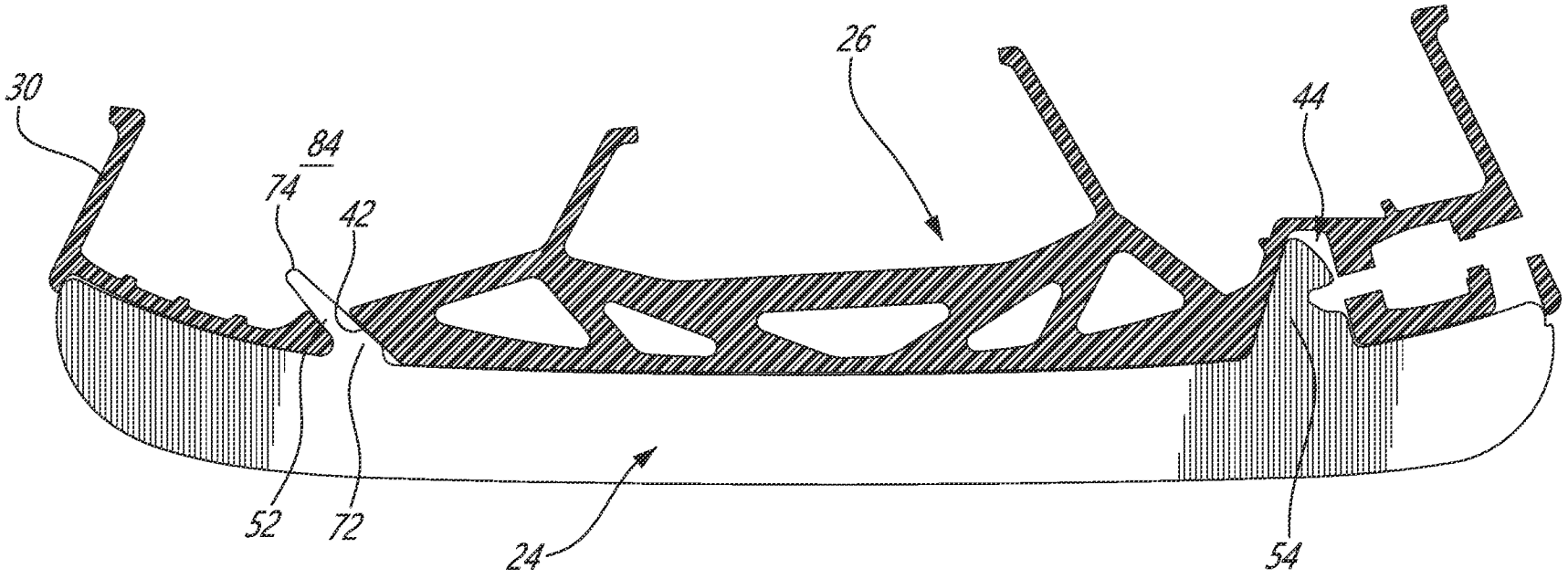
FIG. 8 is a cross-sectional view of the blade assembly of FIG. 5, shown with the blade in an engagement position, with the front projection of the blade fully inserted into the front recess of the blade holder and the rear projection of the blade fully inserted into the rear recess of the blade holder.

In order to attach the blade 24 to the holder 26 using the locking mechanism 28 as described above, the blade 24 may first be positioned into its final "in-use" position (i.e. to permit skating with the skate 10) within the holder 26. This position is shown in FIG. 8. In order to insert the blade 24 into this position within the blade holder 26, the following insertion process may be employed.

Referring first to FIG. 5, and as noted above, the front projection 52 of the blade 24 extends forwardly (i.e. towards the front of the blade) at an angle and may thus be defined as forward-leaning or forwardly inclined. The front projection 52 also has a base 72 that is wider (in a longitudinal or fore-aft direction of the blade 24) than its tip 74, when viewed from the side as in FIGS. 5-8. The front projection 52 therefore converges towards its tip 74 (i.e. it is converging) and may also be said to be tapered, from its base 72 towards its tip 74. The width of the front projection 52, in a direction transverse to the fore-aft direction (or into the page in FIGS. 5-8), may be substantially constant (±2% of width) along its length from the base 72 to the tip 74.

Referring still to FIG. 5, when the blade is to be inserted into the holder 26, the tip 74 of the front projection 52 is first aligned with an outer opening 82 of the front recess 42 defined in the blade holder 26, with the rear portion of the blade 24 and especially the rear projection 54 spaced apart from the holder 26. The blade 24 may therefore be positioned, for example, at an angle relative to a substantially horizontally positioned blade holder 26, as shown in FIG. 5, so as to permit a smooth insertion of the front projection 52 of the blade 24 into the front recess 42 of the holder 26.

In the depicted embodiment, the front recess 42 opens into an internal cavity 84 defined within the front pedestal 30 of the blade holder 26. As such, as the front projection 52 is inserted into the front recess 42, the front projection 52 may slide (or otherwise engage) within the front recess 42 and the tip 74 of the front projection 52 may at least partially protrude into the internal cavity 84 within the front pedestal 30 (see FIGS. 7-8, for example).

Figure 6:
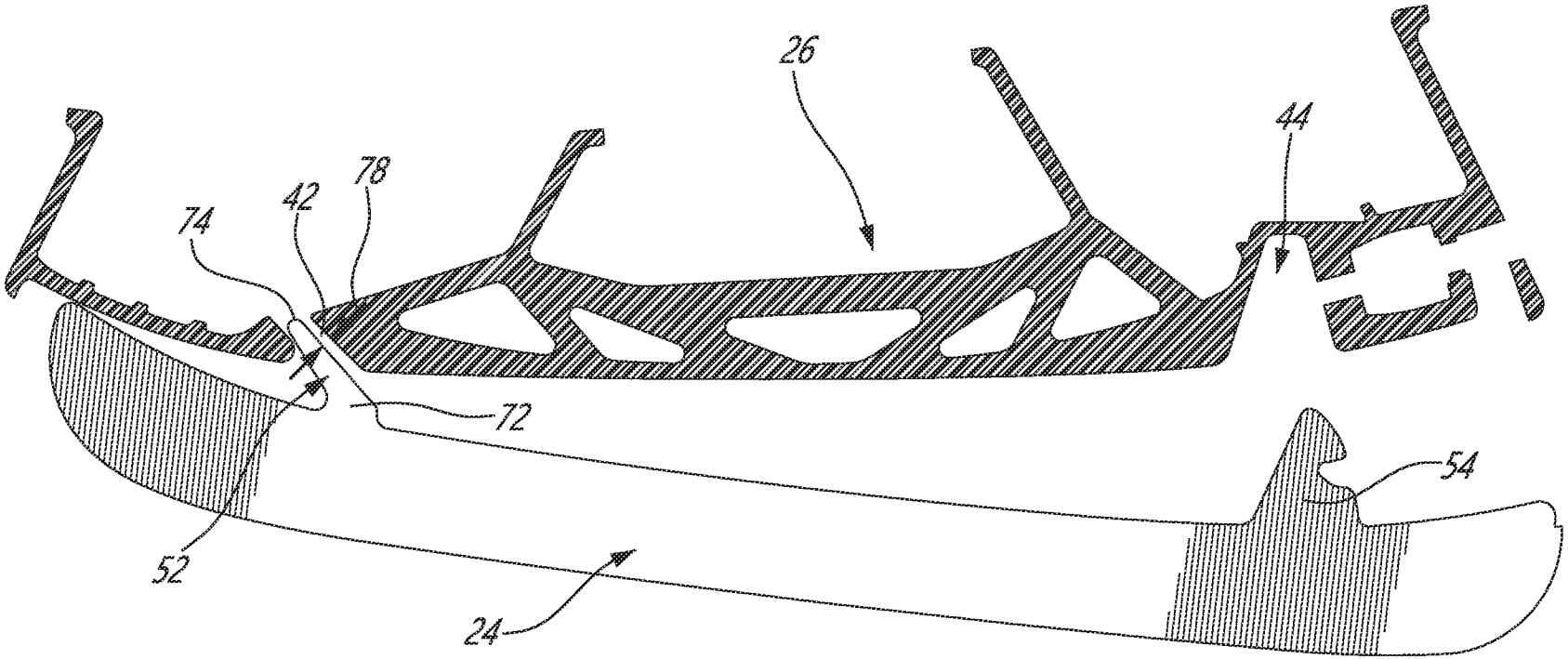
FIG. 6 is a cross-sectional view of the blade assembly of FIG. 5, shown with a front projection of the blade partially inserted into a front recess in the blade holder.
Figure 7:
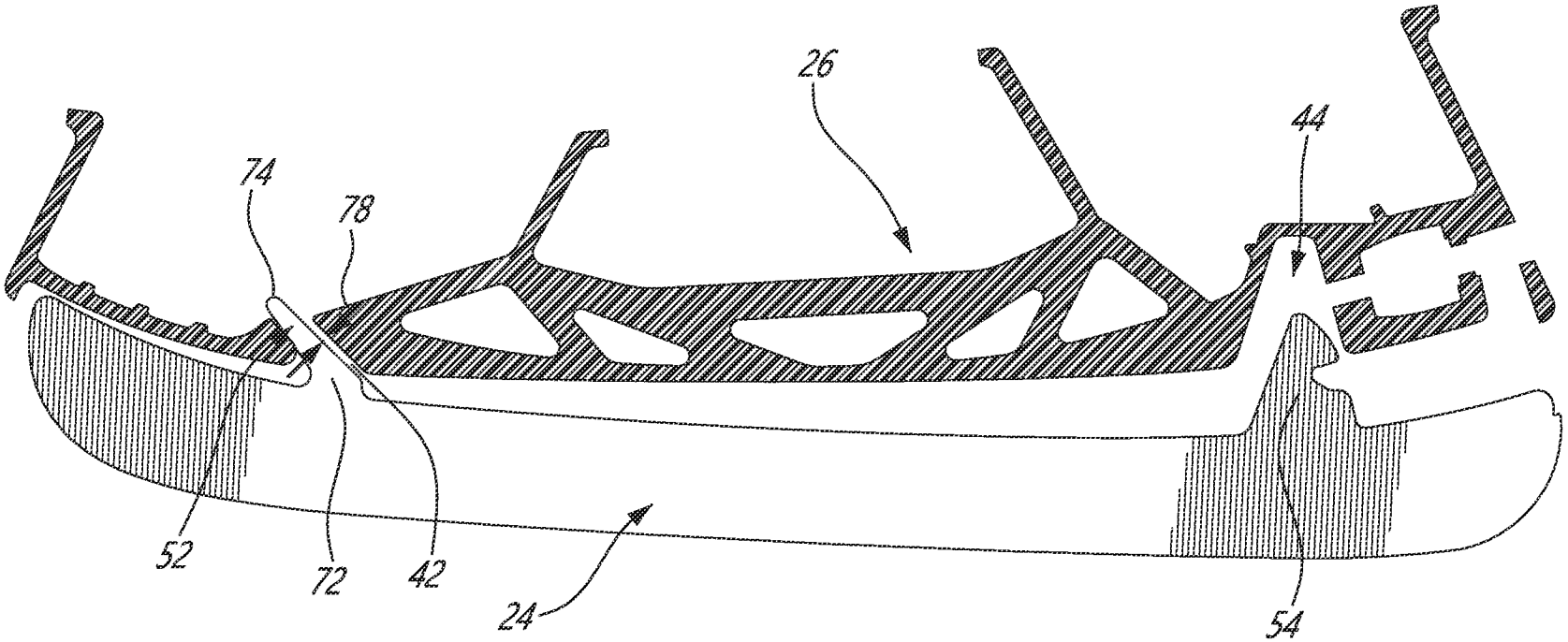
FIG. 7 is a cross-sectional view of the blade assembly of FIG. 5, shown with the front projection of the blade inserted further into the front recess of the blade holder and a rear projection of the blade partially inserted into a rear recess of the blade holder.

As the front projection 52 of the blade 24 is being inserted into the front recess 42 of the holder 26, via a sliding mating engagement, the blade 24 may rotate such that the blade 24 is in a partially-inserted position relative to the holder 26 as shown in FIGS. 6 and 7. During this insertion of the front projection 52 into the front recess 42, the blade 24 may also be slightly translated axially (in an forward direction). However, the relative rotational movement of the blade 24 relative to the holder 26 may be greater than the relative axial movement of the blade 24 relative to the holder 26, as the blade 24 goes from its fully disengaged position to its fully engaged position (FIG. 8).

The front recess 42 of the blade holder 26 is sized so as to snugly receive or mate with the wider base 72 of the front projection 52 when the front projection 52 is fully inserted into the front recess 42 (FIG. 8). The base 72 of the projection 52 may thus matingly engage with the convex surface 42FC of the front wall portion 42F of the recess 42 (described above). Such snuggle engagement may be a slide fit, for example. However, because of the tapered shape of the front projection 52, as the front projection 52 is being slid into the front recess 42 (FIGS. 6-7) a gap 78 is defined between a rearward facing surface of the front projection 52 and a forward facing wall, corresponding to the straight wall segment 42RS described above with respect to FIG. 4, of the front recess 42. As shown in FIGS. 6 and 7, this gap 78 will close as the front projection 52 is inserted further into the front recess 42, until it is fully closed—i.e. the forward facing wall of the front recess 42 and the rearward facing surface, which may include both the straight wall segment 42FS and the convex surface 42FC described above, of the front projection 52 may be fully abutted against each other as shown in FIG. 8. However, while this gap 78 remains as shown in FIGS. 6 and 7, rotation of the blade 24 relative to the blade holder 24 is possible. A play between the front projection 52 and the front recess 42 when the front projection 52 is not fully engaged in the recess 42 may allow for such rotational degree of freedom.

Accordingly, the converging tapered shape of the front projection 52 of the blade 24 allows for a rotational and translational movement of the blade 24 relative to the blade holder 26, which permits the blade 24 to be more easily inserted into position within the blade holder 26. This would not be possible, or would at least be impeded, if the front projection 52 had a constant (i.e. non-tapered) thickness in the longitudinal direction and was received into a correspondingly shaped closed tunnel.

The resulting fully-mated position of the front projection 52 and the front recess 42, as shown in FIG. 8, results in a mating connection between the blade 24 and the blade holder 26 that is more stable and secured.

Figure 9:
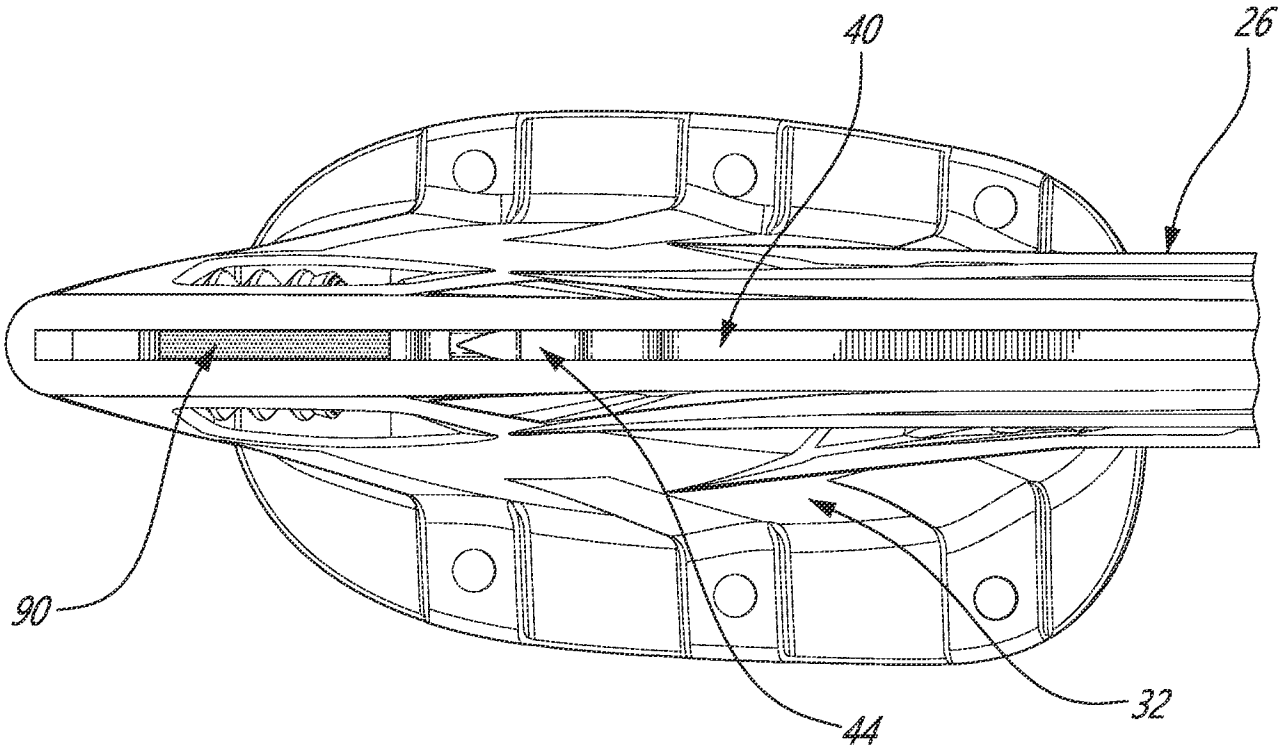
FIG. 9 is a bottom partial view of the blade assembly of FIGS. 1-2, shown without the blade.

Referring to FIG. 9, a damping feature of the blade holder 26 is shown at 90. The damping feature 90 defines an interface with a portion of the top edge 50 of the blade 24 when the blade 24 is engaged in the groove 40 of the blade holder 26. The damping feature 90 may damp vibrations or impact energy between the blade 24 and the blade holder 26. The damping feature 90 may have energy absorption properties. The damping feature 90 may deform when compressed, as the blade 24 is inserted in the holder 26. Manufacturing tolerances may cause small gaps or play between the blade 24 and the holder 26 and as such, the damping feature 90 may allow a better mating engagement between the blade 24 and the holder 26 at an interface thereof. As shown, the damping feature 90 extends in the groove 40. The damping feature 90 may include a strip of material softer than the material of the holder 26. For example, the strip may be made of a thin sheet of polyvinyl chloride (PVC) which may, due to its small thickness (e.g., between 0.1 mm and 0.5 mm) be easily deformable upon compression between the blade 24 and the holder 26. The strip may be adhered to the holder 26 by an adhesive. The damping feature 90 could also form part of the holder 26, such as by co-molding, for example. In the embodiment shown, the damping feature 90 is located underneath the rear pedestal 32, within the groove 40. The damping feature 90 extends rearwardly from the recess 44 engageable by the projection 54. between a rear end of the holder 26 and the recess 44. Even though the damping feature 90 may have some advantages, it may be optional in some embodiments.

The above description is meant to be exemplary only, and one skilled in the art will recognize that changes may be made to the embodiments described without departing from the scope of the invention disclosed. For instance, the mechanism need not be located on the rear pedestal and may alternatively be located on the front pedestal. Still other modifications which fall within the scope of the present invention will be apparent to those skilled in the art, in light of a review of this disclosure, and such modifications are intended to fall within the appended claims.

The invention claimed is:

1. A skate comprising:

a boot;

a blade assembly including:

a blade holder attached beneath the boot, the blade holder having a bottom surface defining a groove and recesses extending upwardly from the groove, the blade holder having a socket defining a socket opening located in a lateral side of the blade holder;

a blade removably mounted to the blade holder, the blade including a body defining an ice-engaging edge and a top edge opposite the ice-engaging edge, projections extending from the top edge and away from the ice-engaging edge, wherein one of the projections has a curved surface having a convex curvature, the curved surface defining a curved cam surface, a slot extending inwardly into said one of the projections from the curved cam surface;

a locking pin displaceable relative the blade holder along a longitudinal axis between a blade locking position in which a tip of the locking pin is in engagement with the blade and a blade releasing position in which the tip of the locking pin is disengaged from the blade, the tip of the locking pin having a locking pin cam surface configured to slide along the curved cam surface of the blade;

a pin actuator received within the socket of the blade holder, the pin actuator engageable by a user for translating the pin actuator along the longitudinal axis, the pin actuator engaged with the locking pin such that translation of the pin actuator induces translation of the locking pin along the longitudinal axis from the blade locking position to the blade releasing position; and a biasing element mounted to the blade holder to react against the pin actuator and biasing the locking pin in the blade locking position.

2. The skate of claim 1, wherein the blade is moveable with respect to the blade holder between an engagement position in which the top edge is received in the groove and a disengagement position in which the blade is disengaged from the recesses and the groove.

3. The skate of claim 2, further comprising a damping feature defining an interface with a portion of the top edge of the blade when the blade is engaged with the blade holder, the damping feature located in the groove.

4. The skate of claim 1, wherein the curved cam surface of said one of the projections of the blade is rearwardly facing, and wherein a tip-engaging wall surface at least partially defines the slot merges with the curved cam surface at a turning point, the locking pin in engagement with the tip-engaging wall surface of the slot in the blade locking position and disengaged from the tip-engaging wall surface in the blade releasing position.

5. The skate of claim 4, wherein the slot has an asymmetrical shape, the tip-engaging wall surface of the slot including a top edge that extends substantially linearly into said one of the projections from the curved cam surface, a bottom edge of the slot facing and spaced apart from the top edge, the bottom edge being curved.

6. The skate of claim 5, wherein the top edge of the slot intersects with the curved cam surface at a point located between an apex of said one of the projections and the top edge of the body of the blade, an upper portion of the curved cam surface extending between the slot and the apex, and wherein an angle is defined between top edge of the slot and the upper portion of the curved cam surface, the angle being an acute angle.

7. The skate claim 4, wherein the tip of the locking pin has a top edge extending on an opposite side of the locking pin cam surface, at least part of the top edge contacting the tip-engaging wall surface of the projection in the blade locking position.

8. The skate of claim 1, wherein the tip of the locking pin has an apex and the locking pin cam surface extending from the apex, the locking pin cam surface being curved.

9. The skate of claim 1, wherein the tip of the locking pin has an asymmetric shape relative to a horizontal plane containing the longitudinal axis of the locking pin.

10. The skate of claim 1, further comprising a bellows extending between the pin actuator and an oppositely facing surface of the blade holder, the bellows surrounding peripherally the biasing element.

11. The skate of claim 1, wherein the pin actuator has an annular shape to receive the locking pin therein, the pin actuator having a forward-facing surface angled relative to the longitudinal axis, and a seating surface facing opposite to the forward-facing surface, the seating surface engaging the biasing element.

12. The skate of claim 1, wherein the pin actuator is fully recessed within the socket.

13. The skate of claim 1, wherein the pin actuator and the biasing element are fully recessed in the socket.

14. The skate of claim 1, wherein the blade holder has a front pedestal defining an internal cavity and a rear pedestal, a respective one of the recesses opening into the internal cavity.

15. The skate of claim 1, wherein the projections include a front projection and a rear projection, the front projection insertable into a respective one of the recesses defined in the front pedestal, the front projection being forwardly angled and having a tapered shape that converges from a base of the front projection to a tip of the front projection.

16. The skate of claim 1, wherein the projections include a front projection and a rear projection, the rear projection includes an apex and the curved cam surface extending from the apex, the curved cam surface of the rear projection slidingly engaging a locking pin cam surface of the locking pin as the locking pin displaces between the blade locking position and the blade releasing position.

17. A replaceable blade for a skate having a locking pin adapted to removably engage the replaceable blade to a blade holder of the skate, the replaceable blade comprising: a body defining an ice-engaging edge, a top edge opposite the ice-engaging edge, a first projection and a second projection each extending upwardly from the body, the first and second projections configured for being received within a respective recess defined by the blade holder of the skate; wherein the second projection defines a rearwardly facing edge that forms a curved surface having a convex curvature, the curved surface defining a curved cam surface along which a tip of the locking pin is adapted to slide, and a slot that extends inwardly into the second projection from the curved cam surface, the slot adapted to receive the tip of the locking pin therein.

18. The replaceable blade of claim 17, wherein the first projection is a front projection, the front projection being forwardly angled and having a tapered shape that converges from a base of the front projection to a tip of the front projection.

19. The replaceable blade of claim 18, wherein the front projection has a length defined from the base to the tip of the front projection, the front projection having a height defined as a distance between the top edge of the body immediately adjacent the base of the front projection and a tangent line at the tip of the front projection generally parallel to the top edge of the body, and wherein the length is greater than the height.

20. The replaceable blade of claim 17, wherein an upper section of the replaceable blade is adapted to be received within a groove of a blade holder of the skate, the upper section extending between a fore end to an aft end of the replaceable blade, the upper section having a thickness T1 measurable from the top edge to a boundary line that is offset with and generally parallel to the top edge, wherein the first projection has a height H1, the height H1 being at least two times the thickness T1 of the upper section.

21. The replaceable blade of claim 17, wherein slot in the second projection has an asymmetrical shape, the slot being defined at least in part by a top edge that extends substantially linearly into the second projection from the curved cam surface and a bottom edge facing and spaced apart from the top edge, the bottom edge being curved.

22. The replaceable blade of claim 21, wherein the top edge of the slot intersects with the curved cam surface at a point located between an apex of the second projection and the top edge of the body of the replaceable blade, an upper portion of the curved cam surface extending between the slot and the apex, and wherein an angle is defined between top edge of the slot and the upper portion of the curved cam surface, the angle being an acute angle.

* * * * *